United States Patent [19]

Fennekels et al.

[11] 4,314,804

[45] Feb. 9, 1982

[54] PROCESS FOR WASHING DYED OR PRINTED TEXTILE MATERIAL

[75] Inventors: Peter Fennekels; Ernst Waltmann, both of Krefeld, Fed. Rep. of Germany

[73] Assignee: Girmes-Werke AG, Grefrath, Fed. Rep. of Germany

[21] Appl. No.: 115,415

[22] Filed: Jan. 25, 1980

[30] Foreign Application Priority Data

Jan. 27, 1979 [DE] Fed. Rep. of Germany ..... 2903134

[51] Int. Cl.[3] ..... B08B 7/04; C11D 9/42; C11D 1/02; C11D 1/86

[52] U.S. Cl. ..... 8/137; 8/553; 252/542; 252/108

[58] Field of Search ..... 8/137, 553; 252/542

[56] References Cited

U.S. PATENT DOCUMENTS

| | | | |
|---|---|---|---|
| 1,948,568 | 2/1934 | Farber et al. | 8/138 |
| 2,189,209 | 2/1940 | Jamgotch | 8/149.1 |
| 2,798,788 | 7/1957 | Studer et al. | 8/553 |
| 2,971,812 | 2/1961 | Moran et al. | 8/553 |
| 3,000,830 | 9/1961 | Fong et al. | 252/542 |
| 3,042,573 | 7/1962 | Roberts | 427/296 |
| 3,530,517 | 9/1970 | Nohl | 8/137 |
| 3,689,435 | 9/1972 | Berni et al. | 252/542 |
| 4,023,526 | 5/1977 | Ashmus et al. | 427/244 |
| 4,118,189 | 10/1978 | Reinwald et al. | 8/137 |

FOREIGN PATENT DOCUMENTS

| | | | |
|---|---|---|---|
| 2410824 | 9/1975 | Fed. Rep. of Germany . | |
| 7209130 | 1/1973 | Netherlands | 252/542 |

OTHER PUBLICATIONS

Schwartz et al., *Surface Active Agents,* Interscience Publ., New York, 1949, p. 427.

*Primary Examiner*—Maria Parrish Tungol
*Attorney, Agent, or Firm*—Schwartz, Jeffery, Schwaab, Mack, Blumenthal & Koch

[57] ABSTRACT

Disclosed is a process for washing dyed or printed textile material to remove unwanted substances from the dying or printing process, comprising the steps of applying to the textile material a foam which is produced from a liquid and contains at least one surface active agent and a component which is soluble in the liquid, has substantially no affinity for the fibers of the textile material and possesses a substantial adsorption capacity for the substances to be removed; working the foam into the textile material; and removing the foam. Also disclosed is a liquid composition for carrying out the disclosed process.

6 Claims, No Drawings

PROCESS FOR WASHING DYED OR PRINTED TEXTILE MATERIAL

BACKGROUND OF THE INVENTION

The present invention pertains to a process for washing or rinsing dyed or printed textile material, preferably continuous rolls of textile material which are in the form of pile fabrics. In this process, a foam containing the active washing agent is brought onto one side of the textile material, the foam is subsequently worked into the textile material and then is removed from the textile material along with the substances which are to be washed out of the material.

Directly following the fixing process in the case of dyed or printed textile products, it is required to wash the products for the purpose of removing unfixed dyestuff, and concentration and other chemical residues. In order to carry out this washing procedure in a continuous process, it was previously required to utilize up to 15 washing apparatuses, each having about 3–5 cbm capacity in series with continuous addition of water. The entire amount of liquid, containing the substances washed out of the textile material, was then discharged into the sewer system. These large amounts of washwater represent a significant burden on the environment. Thus, there existed an urgent desire to reduce this large use of water, the discharge of correspondingly greater amounts of contaminated water into the sewer system and also the energy consumption which resulted from the required heating of the water, in this type of washing process.

Accordingly, efforts have been undertaken recently to improve the efficiency of the washing machines. The basic idea in this regard is always to intensify the relative movement of the washing solution and the goods being washed. Thus, for example, in German Pat. No. 1,113,201, there is disclosed a washing machine in connection with which the continuous band of textile material is introduced into a washwater vessel via a sieve drum which is mounted on an excentric. As a result of rotation of the excentric, the textile material is moved back and forth through the washwater in a vibrating manner. In the washing machine according to German Offenlegungsschrift No. 2 334 998, the continuous band of textile material is introduced by means of a normally rotating perforated drum, and in this device, the effect of high pressure spray nozzles is utilized. In this machine there also takes place a strong relative movement of the washwater and the textile material and thus a correspondingly higher exchange of substances between the two. The required usage of water and energy is still quite considerable in connection with this type of new washing devices.

U.S. Pat. No. 1,948,568 discloses a process for treatment of textile materials in connection with which the treating agent is sucked through the textile material in the form of a foam. A treating agent is present in the liquid which serves for the production of the foam. This liquid is foamed by being blown with a gas and then is brought into contact with the textile material in the form of the foam. Among others, the treating agent can be a washing agent or detergent. Since it is not required that the textile material be operated on with a compact amount of water, the use of water and the amount of wastewater are drastically reduced. Of course, U.S. Pat. No. 1,948,569 permits realization of only the discontinuous foam treatment of individual pieces of textile material.

However, the foam process has also in the meantime been developed as a continuous process, as regards the equipment utilized therefore, such as described in U.S. Pat. No. 3,042,573 and No. 4,023,526, as well as In German Offenlegungsschrift No. 2 214 377. The actual washing within the context of the dyeing process is not considered in these disclosures.

SUMMARY OF THE INVENTION

It is therefore an object of the present invention to provide an improved washing or rinsing process for dyed or printed textile material.

It is a further object of the present invention to provide a continuous washing or rinsing process which can be carried out with the smallest possible amount of liquid.

A further object of the present invention resides in the provision of a washing or rinsing process which can be carried out with the smallest possible amount of energy consumption.

It is a further object of the present invention to provide an improved composition for washing or rinsing of dyed or printed textile material.

In accomplishing the foregoing objects, there has been provided in accordance with the present invention a process for washing dyed or printed textile material to remove unwanted substances from the dying or printing process, comprising the steps of: applying to the textile material a foam which is produced from a liquid and contains at leat one surface active agent and component which is soluble in the liquid, has substantially no affinity for the fibers of the textile material and possesses a substantial adsorption capacity for the substances to be removed; working the foam into the textile material; and removing the foam. Preferably, the textile material comprises a continuous web and said process is carried out in a continuous manner. In one preferred embodiment, the textile material comprises a pile fabric, the foam is applied to the side of the textile material opposite to the pile and the foam is removed by applying suction to the side of the textile material opposite to the side to which the foam is applied.

In accordance with another aspect of the present invention, there is provided a liquid composition for washing dyed or printed textile material to remove unwanted substances from the dyeing or printing process, comprising a carrier liquid, which is preferably water, at least one surface active agent contained in the carrier liquid and an amount of polyvinylpyrollidone sufficient to effect adsorption removal of the unwanted substances from the textile material upon washing the material with a foam produced from the liquid composition.

Further objects, features and advantages of the present invention will become apparent to a person of ordinary skill in the art from the detailed description of preferred embodiments which follows.

DETAILED DESCRIPTION OF PREFERRED EMBODIMENTS

In accordance with the present invention, a foam is evenly applied to a continually moving web or band of textile material. The foam contains one or more surface active agents as well as a compound which is soluble in the liquid of the foam and which possesses no affinity for the fibers of the textile material being treated but which possesses a high adsorption capacity for the substances which are to be washed out of the textile material.

The surface active agents are required for the formation of the foam and for the solvation of the substances to be washed out of the textile material, e.g., not the dyestuffs which are fixed onto the fibers. The substances which are dislodged from the textile material are adsorbed by the above-specified compound and are transported away from the textile material together with this compound during removal of the foam. The adsorbing compound can be incorporated as such into the liquid or alternatively can be produced directly in the liquid by the addition of its various components. The requirement that this compound can have no affinity for the fibers of the textile material means that the compound, corresponding to its purpose as a means for taking up and transporting the substances to be washed on the textile material, can neither become fixed to the fibers nor penetrate into them, and furthermore that the compound may not form any kind of bond with the fibers.

The fluid will be, in general, an aqueous system. However, other types of fluid systems are also not excluded, if they produce foams and in general show the same effect.

The working of the foam into the textile material and the subsequent removal thereof takes place in accordance with the present invention preferably in the manner that the foam is drawn through the textile material by suction from the side thereof opposite to the side to which the foam has been applied, and then is removed, as is disclosed in U.S. Pat. No. 1,948,568 and No. 3,042,573, the disclosure of which is hereby incorporated by reference. However, it is also possible, for example, to squeeze or wring between rollers the textile material carrying the foam, whereby, a penetration effect of the textile material with the foam and its removal can likewise be carried out in a single operation.

As surface active agents, there may be employed an anionic surface active agent or any synergetic mixture of anionic and non-ionic surface active agents. As anionic surface active agents, there may be employed the alkali metal salts of n-alkylsulfates, n-alkylbenzolsulfates or the n-methyl-N-oleolyltaurate or alkali or ammonium salts of fatty acids having not less than 12 carbon atoms. As non-ionic surface active agents there may be employed alkyl polyglycol ethers or oxyethylated alkyl phenols.

In the most preferred embodiment of the present invention, the compound which possesses the high adsorption capacity for the substances which are to be washed out of the textile material is formed in the washing liquid by polyvinylpyrollidone. This polymer already naturally possesses the capacity for complex formation with the various substances and therefore by itself functions as the compound recited in the broad definition of the present invention which possesses a high adsorption capacity for the substances to be washed out of the textile material. However, in particular, it has been found that polyvinylpyrollidone and surface active agents interreact with one another in aqueous solution in an exchange effect and produce further such compounds in the form of surface active agent-polymer-adsorption complexes, which, for example, solubilize dyestuffs and have micelle-like properties (see Henkel-Referate 5, (March 1970), pages 8–12). The polyvinylpyrollidone in the foam mixture functions accordingly as an up-take agent and subsequently as a transport agent. The effect is so good that, with only a single passage through the material of the foam containing polyvinylpyrollidone, it is surprisingly possible to substantially remove non-bound dyestuff, concentration residues and chemical residues from the dyed or printed textile material, which is recognizable in the test for rub resistance, in particular, the test for wet rub resistance. By suctioning away the foam from the side of the material opposite to the side on which the foam is applied, it is possible to remove approximately 80% of the applied foam from the textile material. An after-rinse is recommended for removal of the foam residue.

The extent is clearly recognizable to which the use of water and energy for washing of textile material is decreased by the process according to the present invention.

For the purpose of increasing the effectiveness, it is possible to apply the foam with a temperature of between about 60°–95° C.

In the case of washing pile fabrics, it has been demonstrated that the effect is better if the web of material is transported with the pile directed downwardly and the foam applied to the backside of the material. The foam is then suctioned through the material from the pile side of the fabric.

In the case of dyeing processes which require an oxidative after-treatment, such as the vat dyestuff or the sulfur dyestuff dying processes, the washing process according to the present invention can be combined with the oxidative after-treatment. In such a procedure, the oxidizing agent, e.g., hydrogen peroxide in the case of vat dying, is added to the foam-forming liquid.

The foam-forming liquid can contain still other conventional components in addition to the components according to the present invention. Thus, for example, in addition of foam stabilizing agents, e.g., of the type of the fatty acid ethanolamides is advantageous. Also, additional ingredients of commercially available detergents can be contained in the liquid, such as carboxymethylcellulose.

EXAMPLE

A velvet is chosen having the following construction:
Pile—pure cotton
Warp—pure cotton
Woof—pure cotton After conventional pre-washing and bleaching, the fabric is dyed substantively to the color black in an aqueous bath along the continuous dying line. After exiting from the steamer, the velvet, while being held horizontal and planar with the pile directed downward, is covered evenly on its backside with a layer of foam at a height of 1 to 10 cm. The foam is produced from a liquid which contains two anionic surface active agents in an amount of 20 grams per liter of water and polyvinylpyrollidone in an amount of 30 grams per liter of water. The liquid has a temperature in a range of 60° to 95° C. The liquid is mechanically beaten into foam in a volume ratio of 1:8, and by means of a suitable device, for example, a hose conduit having movable tubular nozzles, the foam is applied to the textile material. The textile material then runs over a suction opening or a suction roller on which approximately 80% of the applied foam mass which now also contains the substances extracted from the textile material is removed from the textile web. These substances are the unfixed portion of the dyestuff and the concentration and chemical residue of the previously conducted dying process.

In order to remove the residual portions of the foam and the substances, there is carried out a short after-rinsing of the textile material with water having no additives.

The wet rub resistance test of the surface of the textile material according to DIN 54021 is an exact test for the degree of purity of the material. It corresponds to the values which have been found in the case of the conventional washing process after passage through a plurality of washing stages.

Subsequent to the rinsing, the textile material is further treated on the velvet finishing line in the conventional manner with urea-formaldehyde and silicone dispersion for the purpose of providing wrinkle-resistance and/or water-resistance.

The polyvinylpyrollidone used in the example was a poly-N-pyrollidone, a product called "Albigen" of Badische Anilin- und Sodafabrik AG, Ludwigshafen (Germany), having a K-value of 20–100. The tenside used was a synergistic mixture of sodium hexadecylsulfate and of oxyethylitic nonylphenol.

What is claimed is:

1. A process for washing dyed or printed textile pile fabric to remove unwanted residual substances from the dying or printed process of the fabric, comprising the steps of:

applying to the side of the fabric opposite the pile a foam which is produced from a liquid consisting essentially of at least one surface active agent and polyvinylpyrrolidone, said foam having a temperature of between about 60° C. and 95° C. during application to said fabric; and removing the foam by applying suction to the pile side of fabric wherein said process is carried out in a continuous manner.

2. A process according to claim 1, wherein said surface active agent comprises an anionic surface active agent or a mixture of an anionic and non-ionic surface active agents.

3. A process according to claim 2, wherein said anionic surface active agent comprises an alkali metal salt of an n-alkyl sulfate, an n-alkylbenzolsulfate or n-methyl-N-oleoyltaurate or an alkali metal or ammonium salt of a fatty acid having at least 12 carbon atoms.

4. A process according to claim 2, wherein said non-ionic surface active agent comprises an alkyl polyglycol ether or an oxyethylated alkyl phenol.

5. A process according to claim 1, further comprising the step of rinsing the textile material with water after removal of said foam.

6. A process according to claim 1, wherein said textile pile fabric has been dyed with a vat dyestuff or a sulfur dyestuff, which requires an oxidative after-treatment, and wherein said liquid further comprises an oxidizing agent suitable for said after-treatment.

* * * * *